United States Patent [19]

Daleus, deceased et al.

[11] Patent Number: 4,954,117

[45] Date of Patent: Sep. 4, 1990

[54] SAWING ACTION FIGURE TOY

[76] Inventors: Camille Daleus, deceased, late of Montreal; by Ursule Dubreuille, legal representative; by Régine Daleus, legal representative, both of 11,950 Grenet, Apartment 501, Montreal, all of Canada, H4J 2L6

[21] Appl. No.: 365,540

[22] Filed: Jun. 13, 1989

[51] Int. Cl.[5] ..... A63H 11/12

[52] U.S. Cl. ..... 446/280; 446/330; 40/219

[58] Field of Search ..... 496/268, 269, 272, 274, 496/275, 276, 277, 279, 280, 288, 289, 292, 330, 371, 376; 40/411, 415, 418, 419, 420

[56] References Cited

U.S. PATENT DOCUMENTS

| | | | |
|---|---|---|---|
| 90,700 | 6/1869 | Taylor . | |
| 300,799 | 6/1884 | Ricker . | |
| 300,800 | 6/1884 | Ricker . | |
| 453,673 | 6/1891 | Snyder . | |
| 717,295 | 12/1902 | Soulée | 40/419 X |
| 1,356,901 | 10/1920 | Barger . | |
| 1,370,337 | 3/1921 | Megerlin | 40/419 X |
| 1,610,568 | 12/1926 | Marx . | |
| 1,872,192 | 8/1932 | Smithson et al. . | |
| 1,894,105 | 1/1933 | Kupfer | 40/419 X |
| 2,022,047 | 11/1935 | Latta . | |
| 2,023,516 | 12/1935 | Cowen . | |
| 2,133,943 | 10/1938 | Barrette . | |
| 2,135,850 | 11/1938 | Schmid . | |
| 2,147,600 | 2/1939 | Fisher . | |
| 2,400,980 | 5/1946 | Dishmaker . | |
| 2,523,417 | 9/1950 | Brown . | |

FOREIGN PATENT DOCUMENTS

| | | |
|---|---|---|
| 253601 | 9/1925 | Canada . |
| 411373 | 3/1943 | Canada . |

*Primary Examiner*—Mickey Yu
*Assistant Examiner*—Sam Rimell

[57] ABSTRACT

An action toy consisting of a main frame, a pair of wheels journalled to the frame by corresponding shafts for rollingly supporting same on the ground, a handle fixed to the frame, a hollow human figure, the feet of which are anchored to the rearward section of the frame so that his legs extend upwardly therefrom, a wooden log anchored to the frontward section of the frame in substantially horizontal register with his hands, a bucksaw having a rear handle grasped by the figure's hands and a lower horizontal blade slidingly engaging a groove made about a transverse section of the log. The human figure includes waist, shoulders, neck, and elbows pivot members, for pivotal action thereabout. A cord-transmission transmits power from that induced by the continuous rotation of one of the shafts, to actuate the pivot rods concurrently and transform the continuous rotation into a reciprocating fore-and-aft motion of the figure's arms and of his forearms relative to his arms, and into an alternating up-and-down motion of the figure's trunk and of his head relative to his trunk. Hence, apparent sawing of the log by the bucksaw is effected by rolling the toy on the ground.

8 Claims, 4 Drawing Sheets

SAWING ACTION FIGURE TOY

FIELD OF THE INVENTION

This invention relates to toys for children, these toys having a frame with wheels for rolling on the ground, and characterized in that they include figures of animals or human beings which have some limbs movable through a transmission means linked to the rotatable shaft of the wheels.

BACKGROUND OF THE INVENTION

In the prior art known to the present inventor, there is usually disclosed a toy carried by wheels designed to roll on the ground and an animal or human figure having up to three pivotal axles for relative movement of up to three limbs or parts of the body of the figure. Such relatively movable parts may or may not be concurrently actuated by a transmission mechanism, linked to the rotation of the wheels when a child pushes the toy for rolling same on the ground.

For instance, the U.S. Pat. No. 2,022,047 to Latta discloses a dunkey in which the head is pivotable relative to the trunk about axle 37. In U.S. Pat. No. 2,135,850 to Schmid, the torso of a human figure is pivotable relative to the legs, about axle s. U.S. Pat. No. 1,356,901 to Barger shows that it is known to provide such human figures in which the arms are pivotable relative to the torso thereof under power from the rotating wheels of a vehicle (here, Santa Claus' sleigh). In U.S. Pat. No. 1,610,568 to Marx, it is shown that movement of the legs of a human figure relative to his thigh, under driving power from a transmission gear linked to the front wheels of a buggy, is known in the art.

OBJECTS OF THE INVENTION

The object of the invention is to provide an improved action toy, in which a human figure has at least four limbs or parts thereof concurrently movable relative to each other under power from a transmission linked to the wheels rotatably carrying the toy over ground.

SUMMARY OF THE INVENTION

In accordance with the object of the invention, there is disclosed an action toy consisting of a main frame, a pair of wheels journalled to said frame by a shaft member for rollingly supporting same on a flat horizontal surface, a handle fixed to said frame, a hollow human figure defining feet, legs, a trunk, a head, arms, forearms, hands, a waist, a neck, shoulders, and elbows, said feet being anchored to the rearward section of said frame so that said legs extend upwardly therefrom, a wooden log anchored to the frontward section of said frame in substantially horizontal register with said hands, a bucksaw having a rear handle grasped by said hands and a lower horizontal blade slidingly engaging a groove made about a transverse section of said log; wherein said human figure includes waist, shoulders, neck, and elbows pivot members, for pivotal action thereabout; further including transmission means, to transmit power from that induced by the continuous rotation of said shaft member, to actuate said pivot members concurrently and transform said continuous rotation into a reciprocating fore-and-aft motion of said arms and of said forearms relative to said arms, and into an alternating up-and-down motion of said trunk and of said head relative to said trunk; whereby apparent sawing of said log by the bucksaw is effected by rolling the toy on said horizontal surface.

According to a specific feature of the invention, the transmission means includes: a cord, anchored at one end to an eyelet member which is mounted to said shaft member for translation thereabout without winding of said cord about said shaft member, said cord brought by guide means through a bore in one of said feet and into the hollow of the human figure to become anchored at its other end to one end of a rocker lever intermediately pivoted to said shoulders pivot member; and a first biasing means, to bias said rocker lever one end toward said head; the pulling of said cord produced by a first half rotation of said shaft member adapted to bring said arms and forearms from a rearward position to a forward position and said trunk and head from an upright position to a downwardly-inclined position further including second biasing means, to bring said arms and forearms back in their initial rearward position and said trunk and head back in their initial upward position, during the free retraction of said cord produced by the second half of the rotation of said shaft member.

Advantageously, the shaft member will include a short shaft journalled to each corresponding wheel, these two shafts being coaxial and spaced from one another; said eyelet member including a stem, radially outwardly projecting from the interior face of one of said shafts, and an eyelet anchored at the radial outer end thereof, said cord anchored to said eyelet. There could then be third biasing means, to bias said rocker lever one end toward said head, the latter means anchored at their bottom end to the lower front section of said trunk. Preferably, the second biasing means includes a biasing member for biasing said trunk coaxially to said legs and consisting of a spring member, biasing toward each other the upper rear section of said trunk and the upper rear section of said one of said legs. Alternately, these second biasing means could include a biasing member for biasing said head coaxially to said trunk and consisting of a spring member, biasing toward each other the lower rear section of said head and the intermediate front section of said trunk.

Dynamo means are envisioned to be coupled to the shaft member to transform rotational mechanical motion thereof into electric power, for aligning a lamp mounted to the front of the toy.

Preferably, a rigid balloon is journalled by an idle rod to said frame above said shaft member between said wheels; said rod and said shaft member interconnected by an endless belt, the latter being crossed wherein clockwise rotation of the wheels brings counterclockwise rotation of the balloon.

A bar could be journalled to said waist pivot member and be downwardly dependent therefrom, said bar engaging an arcuate cavity made in a concave interior projection of said trunk within each of said legs; said bar and arcuate cavity interplay thereby defining two limit positions for the trunk during the pivotal action thereof about the latter pivot member.

Said neck pivot member is preferably a pivot pin, journalled into the wall of the upper edge section of said trunk and slidingly engaging two short inclined opposite slits made in the lower edge section of said head; said pivot pin and inclined slits interplay providing for motion of said head relative to said trunk between two limit positions.

DETAILED DESCRIPTION OF THE PREFERRED EMBODIMENT OF THE INVENTION

Figure 1:
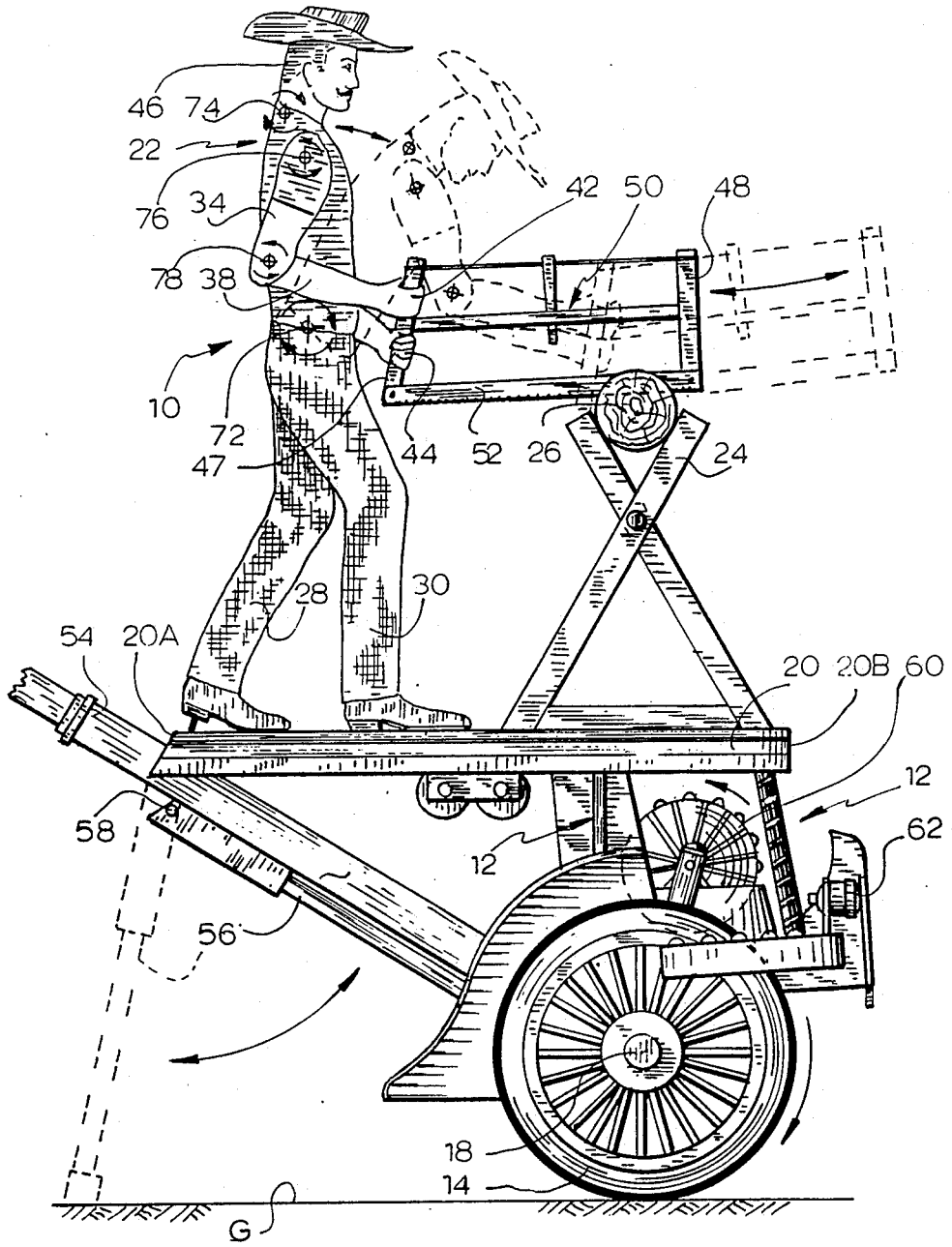
FIG. 1 is a side elevational view of the action toy, showing the relative motion of the movable elements thereof in dotted lines.
Figure 2:
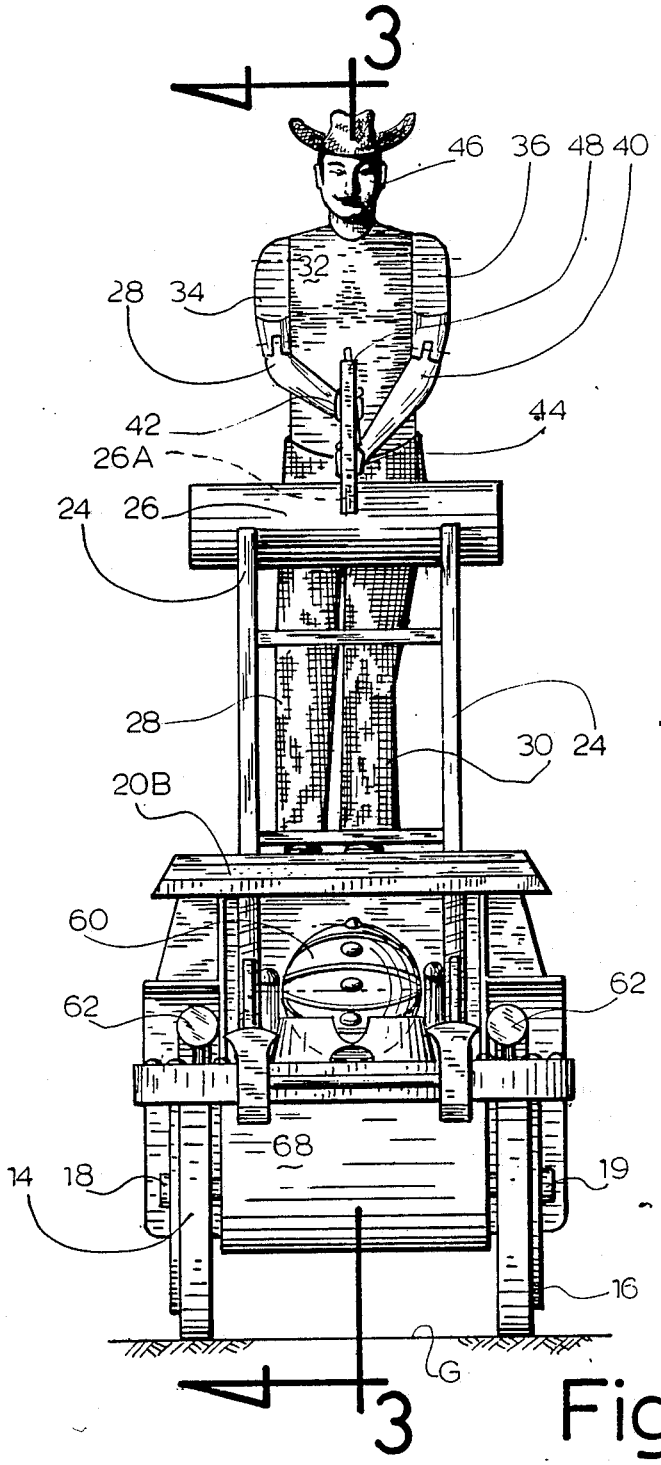
FIG. 2 is a front elevational view of the action toy.
Figure 3:
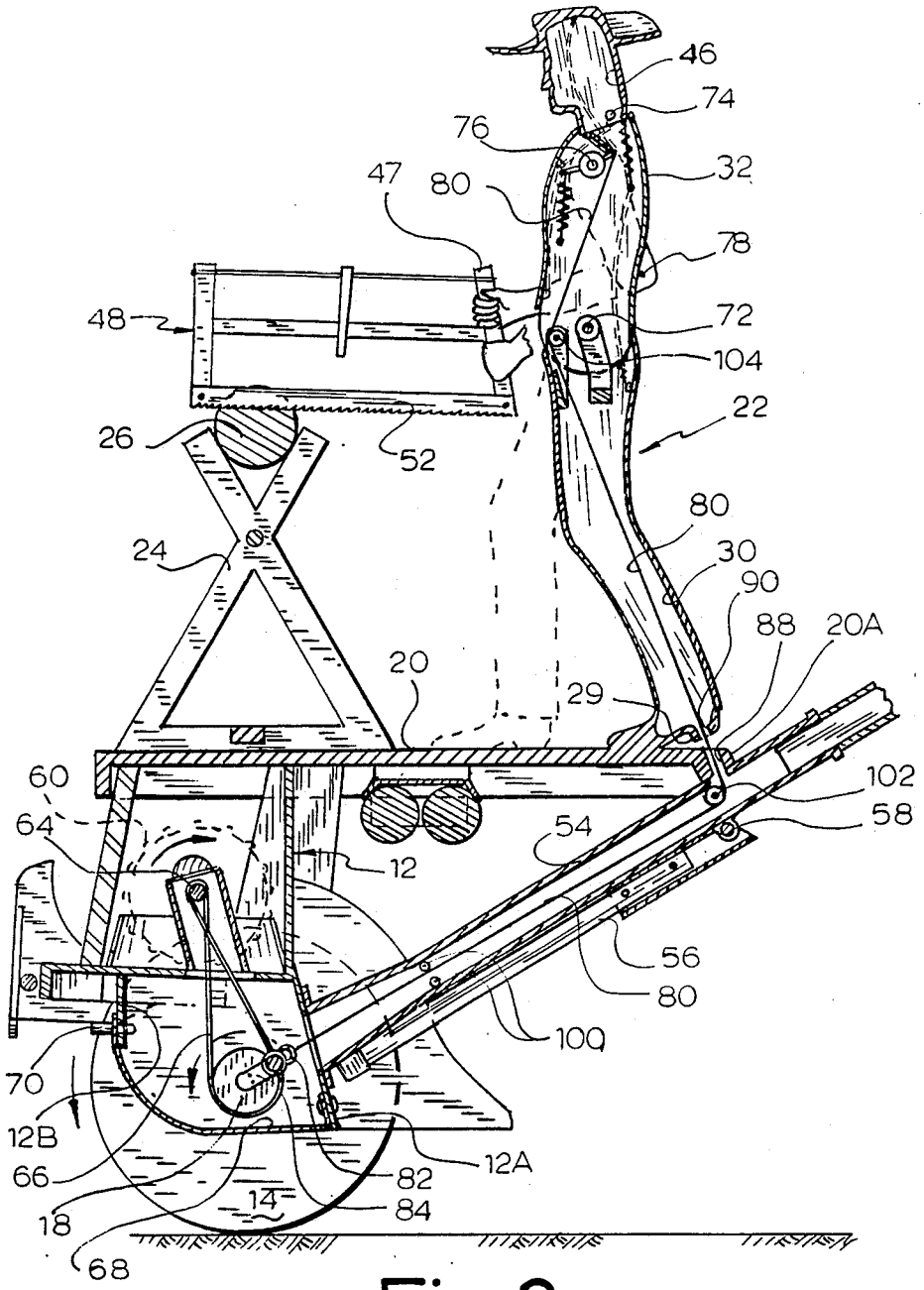
FIG. 3 is a vertical sectional view taken along line 3—3 of FIG. 2.

Action toy 10 consists of a large open frame 12, supported over ground G by a pair of opposite front wheels 14, 16 each journalled to a specific idle shaft 18, 19, respectively. Shafts 18 and 19 are coaxial but spaced from each other. Frame 12 itself supports a large overlying flooring panel 20, on which stands a lumberjack figure 22 at the rear portion thereof and a trestle 24 at the front portion thereof. Trestle 24 supports a faked wooden log 26, which extends parallel to wheel shafts 18, 19. Figure 22 is hollow and includes two legs 28, 30, a trunk 32, two arms 34–36, two forearms 38, 40, hands 42, 44, and a head 46. With the forearms 38–40 extending forwardly slightly downwardly, hands 42–44 are anchored in vertically spaced position to the vertical rear handle 47 forming part of the frame 48 of a large bucksaw 50 defining a horizontal bottom blade 52 engaging a transverse central upper groove 26A in wooden log 26.

At rest, the figure 22 is upright, as shown in FIG. 1, with the forearms 38, 40, extending forwardly slightly downwardly.

An inclined hollow post 54 is also anchored at one end to frame 12, intermediately to the rear edge 20A of the flooring 20, and extend upwardly rearwardly therefrom. Post 54 extends toward the axis of shafts 18, 19, and its top rear end (not shown) constitutes a handle for maneuvering the toy 10. A stand 56 is pivoted at its top end to post 54, at 58, in register with the flooring rear edge 20A, for movement between a first downwardly slightly rearwardly inclined operative position (shown in dotted lines in FIG. 1) for supporting toy 10 in order to maintain flooring 20 horizontal, and a second forwardly downwardly inclined inoperative position shown in full lines in FIG. 1 abutting against the lower half of post 54 (see the bottom left arrow in FIG. 1). Pivot 58 should be biased by low resiliency spring means, not shown, to bring the stand 56 in the inoperative position, but the weight of toy 10 should be sufficient to prevent expression of the bias of said spring means when the stand 56 is in its said operative position.

Hence, a child may play with his toy 10 by first slightly lifting post 54, in order to push the stand 56 in its inoperative position, and then rollingly push the toy 10 forwardly: as we will see, the lumberjack 22 will concurrently "cut" the log (no cutting will in fact occur) with his (faked) buck saw 50, a balloon 60 forming part of the toy 10 will rotate, and head lamps 62 will illuminate the path of the toy 10. Balloon 60 is rotatably carried by frame 12, slightly below flooring 20 and in register with trestle 24, via a drive axle 64: axle 64 is frictionally connected to wheel axle 18 via an endless belt 66. Belt 66 should preferably be crossed, so that upon clockwise rotation of wheels 14, 16, balloon 60 will rotate counterclockwisely, and vice-versa, as suggested by the two bottom right arrows of FIG. 1.

Dynamo means, not shown, may be further provided, about wheel shaft 19 for instance, to transform the mechanical rotational movement of the latter into electric current to feed headlamps 62 (and possibly also a lantern structure, not shown), that could extend upwardly from the front edge 20B of flooring 20. Access to endless belt 66 for maintenance purposes is possible via a lower flap 68 anchored at its rear edge to a lower rear section 12A of frame 12, and releasably connected by an eyelet 70 at its front edge to a lower front section 12B of frame 12.

As best shown in FIG. 1, FIG. 22 defines four pivotal axes 72, 74, 76, and 78, for relative movement of various parts thereof. Axes 72–78 are substantially parallel to each other and to shafts 18–19. Axis 72 is mounted to the waist of the lumberjack 22, i.e. between the legs 28–30 and the trunk 32: hence, fore-and-aft pivotal movement of the trunk 32, including the head 46, relative to the legs 28–30 is permitted. Axis 74 is mounted to the neck of lumberjack 22, i.e. journalled to the trunk 32 but engaged into a short upwardly rearwardly inclined slit 75 in head 46: hence, fore and aft pivotal movement of the head 46 relative to the trunk 32 is permitted. Axis 76 is mounted to the shoulders of lumberjack 22, i.e. at the intersection of arms 34, 36, and trunk 32: hence, fore and aft pivotal movement of the arms 34, 36, including the forearms 38–40 relative to the trunk 32, is permitted. Moreover, axis 78 is mounted to the elbows of lumberjack 22 (i.e. at the intersection of arms 34–36 and forearms 38–40, respectively): hence up and down pivotal movement of the forearms 38–40, including hands 42–44, relative to the arms 34–36 is permitted.

The heart of the invention lies in the transmission means which translates the rotative motion of shaft 18 into pivotal movement of body parts 32, 34–40, and 46, about their pivots 72, 76, 78, and 74, respectively. Said transmission means includes an elongated cord 80, which is anchored at its bottom end to an eyelet 82 mounted to the free end of an arm 84 extending radially outwardly from the inner face of wheel shaft 18. Radial arm 84 is fixed to the central longitudinal axis of shaft 18 and is thus out of register from endless belt 66. Cord 80 thus extends from shaft 18, through the hollow of the lower half of post 54, into a bore 88 made in the rear edge section 20A of flooring, upwardly of flooring 20, through another bore 90 made in the heel 92 of the foot of leg 30 of lumberjack 22 (heel 92 is slightly lifted from flooring 20) and through the hollow of leg 30 and trunk 32. The top end of cord 80 is anchored to another eyelet 94 about a bulge 96 at one end of a rocking lever 98 being intermediately pivoted to rod axle 76.

Opposite idle rollers 100 are provided into the hollow of the lower portion of post 54, to guide cord 80. A first guide pulley 102 is journalled to the inner wall of post 54, in register with bore 88, to bring cord 80 about a substantially right angle turn in a forwardly inclined direction. A second guide pulley 104 is journalled to an arm 106 projecting from the upper front section of the lumberjack leg 30, in register with axle 72, for bringing cord 80 about a 45° turn in a rearwardly upwardly inclined direction.

The end of rocker lever 98 opposite bulge 96 includes also an eyelet 108, for engagement by one end of a coil spring 110, the other end therefore engaging an ear 112 at the lower front section of trunk 32. SInce lever 98 is biased by spring 110, rotation of wheel shaft 18 will reciprocate cord 80, to concurrently pivot the figure arms 34, 36, fore and aft about their pivot axle 76.

Figure 4:
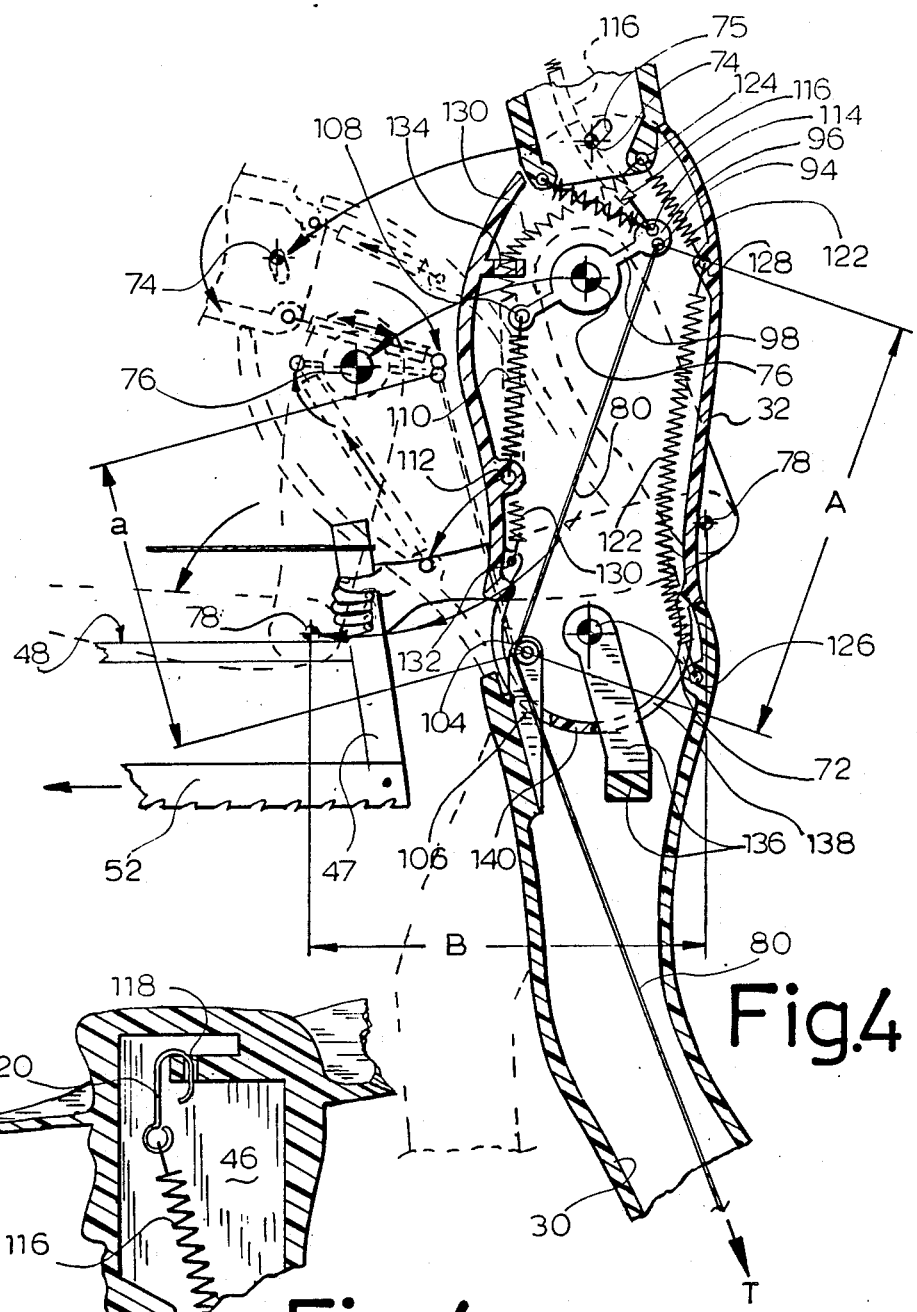
FIG. 4 is a partly broken enlarged view of the upper portion of FIG. 3.
Figure 4A:
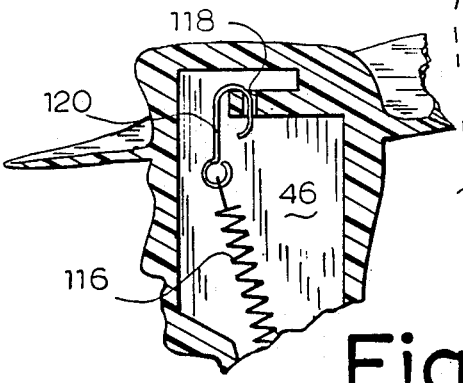
FIG. 4*a* is a broken enlarged view of the topmost part of FIG. 3.

As shown in FIG. 4, the lever bulge 96 further includes another eyelet 114, for engagement by one end of a coil spring 116, the other end thereof extending through the hollow of head 46 to become anchored to an ear 118 at the top of head 46, see FIG. 4*a*. Hence, the pulling of cord 80 will be against the bias of both springs 110 and 116, and thus the trunk 32 of figure 22 will pivot forwardly about its lower axle 72. Trunk 32 will be biased to pivot forwardly, because the axis of the segment of cord 80 between pulley 104 and lever bulge 96 is at an angle from the longitudinal (vertical) axis of trunk 32 when at rest, and because it is as if head 46 directly connected to cord 80 albeit with a lag via dampener members 110 and 116.

An elongated coil spring 122 is anchored at its top end to an ear 124, being at the bottom rear end of head 46, below the level of pivot axle 74, and at its bottom end to an ear 126, at the upper rear section of leg 30 below the level of pulley 104, via an intermediate channel 128 at the upper rear section of trunk 32. Similarly, an elongated coil spring 130 is anchored at its bottom end to an ear 132, being at the bottom front section of trunk 32, and at its top end to said ear 124 of the head 46, via an intermediate channel 134 at the upper front section of trunk 32. Coil springs 122, 130, further contribute in biasing the figure 22 in upright position, that is, in maintaining trunk 32 in vertical register with legs 28, 30.

A forwardly inclined first limit position and an upright second limit position for trunk 32 are defined, thanks to a U-shaped bar 136, downwardly depending from pivot axle 72, the bar 136 engaging an arcuate cavity 138 made in a concave bottom projection 140 of trunk 32.

During pivotal of torso 32, head 46 will slightly forwardly pivot simply by its own weight, relative to torso 32, since pivot pin 74 will slide along its slit 75 from its bottom position shown by the full lines of slit 75 in FIG. 4, to its top position shown by the phantom lines of slit 75 in FIG. 4. It will be brought back by the pulling of cord 80.

During the forward bending of the figure 22, the angle made between arms 34–36 and forearms 38–40, respectively, changes from an acute angle, say of about 75°, to an obtuse angle, say of about 100°: hence, a pivotal action occurs about elbow pivot 78. In fact, pivot 78 is an "idle" pivot, in that the forearms 38–40 merely follow the swinging motion of their arms 34–36, and , since hands 42–44 are anchored to the bucksaw 48, there will consequently be some pivotal motion of the forearms relative to the lumberjack arms.

It is claimed:

1. An action comprising a main frame, a pair of wheels journalled to said frame by a shaft member for rollingly supporting said frame on a flat horizontal surface, a handle fixed to said frame, a hollow human figure defining feet, legs, a trunk, a head, arms, forearms, hands, a waist, a neck, shoulders, elbows, said feet being anchored to the rearward section of said frame so that said legs extend upwardly therefrom, a log anchored to the frontward section of said frame in substantially horizontal register with said hands, a bucksaw having a rear handle grasped by said hands and a lower generally horizontal blade slidingly engaging a groove made about a transverse section of said log; wherein said human figure includes waist, shoulders, neck, and elbows pivot members, for pivotal action thereabout; further including transmission means, to transmit power from that induced by the continuous rotation of said shaft member, to actuate said pivot members concurrently and transform said continuous rotation into a reciprocating fore-and-aft motion of said arms and of said forearms relative to said arms, and into an alternating up-and-down motion of said trunk and of said head relative to said trunk; whereby apparent sawing of said log by the human figure with his bucksaw is effected by rolling the toy on said horizontal surface.

2. An action toy as defined in claim 1, wherein said transmission means includes: a cord, anchored at one end to an eyelet member which is mounted to a radial arm attached to said shaft member, said cord brought by guide means through a bore in one of said feet and into the hollow of the human figure to become anchored at its other end of one end of a rocker lever attached to said shoulders pivot member; and a first biasing means, to bias said rocker lever one end toward said head; the pulling of said cord produced by a first half rotation of said shaft member adapted to bring said arms and forearms from a position to a forward position and said trunk and head from an upright position to a downwardly-inclined position; and a second biasing means, to bring said arms and forearms back in their initial upward positions and said trunk and head back in their initial upward positions, during free retraction of said cord produced by a second half of the rotation of said shaft member.

3. An action toy as defined in claim 1, further including a rigid balloon, journalled by an idle rod to said frame above said shaft member between said wheels; said rod and said shaft member interconnected by an endless belt, said belt being crossed wherein clockwise rotation of the wheels bring counterclockwise rotation of the balloon.

4. An action toy as defined in claim 2, further including third biasing means, to bias said one end of said rocker lever toward said head, said third biasing means anchored to the lower front section of said trunk.

5. An action toy as defined in claim 2, wherein said second biasing means includes a biasing member for biasing said trunk to said legs and consisting of a spring member, biasing toward each other the upper rear section of said trunk and the upper rear section of said one of said legs.

6. An action toy as defined in claim 2, wherein said second biasing means includes a biasing member for biasing said head to said trunk and consisting of a spring member, biasing toward each other the lower rear section of said head and the intermediate front section of said trunk.

7. An action toy as defined in claim 1, further including a bar journalled to said waist pivot member and downwardly dependent therefrom, said bar engaging an arcuate cavity made in a concave interior projection of said trunk within each of said legs; said bar and arcuate cavity thereby defining two limit positions for the trunk during the pivotal action thereof about said waist pivot member.

8. An action toy as defined in claim 1, wherein said neck pivot member is pivot pin journalled into the wall of the upper edge section of said trunk and slidingly engaging two short inclined opposite slits made in the lower edge section of said head; said pivot pin and inclined slits providing for motion of said head relative to said trunk between two limit positions.

* * * * *